US010234223B2

(12) United States Patent
Marina Rodríguez et al.

(10) Patent No.: US 10,234,223 B2
(45) Date of Patent: Mar. 19, 2019

(54) MORTAR SHELL EXTRACTION SYSTEM

(71) Applicant: Expal Systems S.A, Madrid (ES)

(72) Inventors: Adolfo Marina Rodríguez, Madrid (ES); Francisco Javier Ramírez Fernández, Madrid (ES); Iñaki García Pardo, Madrid (ES)

(73) Assignee: Expal Systems S.A., Madrid (ES)

( * ) Notice: Subject to any disclaimer, the term of this patent is extended or adjusted under 35 U.S.C. 154(b) by 0 days.

(21) Appl. No.: 15/541,327

(22) PCT Filed: Dec. 30, 2015

(86) PCT No.: PCT/EP2015/081385
§ 371 (c)(1),
(2) Date: Jun. 30, 2017

(87) PCT Pub. No.: WO2016/107891
PCT Pub. Date: Jul. 7, 2016

(65) Prior Publication Data

US 2017/0370667 A1 Dec. 28, 2017

(30) Foreign Application Priority Data

Jan. 2, 2015 (EP) ..... 15382001

(51) Int. Cl.
*F41A 15/22* (2006.01)
*B66C 1/00* (2006.01)

(52) U.S. Cl.
CPC ..... *F41A 15/22* (2013.01)

(58) Field of Classification Search
CPC ..... F41A 15/22
USPC ..... 294/100, 93, 195
See application file for complete search history.

(56) References Cited

U.S. PATENT DOCUMENTS

| | | | | |
|---|---|---|---|---|
| 2,397,554 A | | 4/1946 | Lontz | |
| 2,770,988 A | | 11/1956 | Jasse | |
| 4,588,222 A | | 5/1986 | Martin | |
| 5,048,393 A | | 9/1991 | Grabner et al. | |
| 5,419,427 A | * | 5/1995 | Wurgler | B65G 47/908 198/803.12 |
| 5,825,837 A | * | 10/1998 | Peters | G21C 19/105 376/261 |

(Continued)

FOREIGN PATENT DOCUMENTS

| | | |
|---|---|---|
| EP | 1691162 | 8/2006 |
| EP | 1712872 | 10/2006 |

(Continued)

OTHER PUBLICATIONS

"International Application No. PCT/EP2015/081385, International Search Report and Written Opinion dated Mar. 21, 2016", (Mar. 21, 2016), 12 pgs.

*Primary Examiner* — Paul T Chin
(74) *Attorney, Agent, or Firm* — Schwegman Lundberg & Woessner, P.A.

(57) ABSTRACT

The present invention relates to a mortar shell extraction system, comprising gripping means adapted for being inserted into the mortar and holding the shell by the fuse, at least one connecting shaft connected to the gripping means, driving means connected to the at least one connecting shaft and configured for transmitting a driving force to the gripping means through the at least one connecting shaft.

9 Claims, 8 Drawing Sheets

(56) References Cited

U.S. PATENT DOCUMENTS

| | | | | |
|---|---|---|---|---|
| 5,987,799 | A | 11/1999 | Dedeaux et al. | |
| 6,398,281 | B1 * | 6/2002 | Heimberg | G01N 35/00 294/100 |
| 6,513,213 | B1 * | 2/2003 | Muramatsu | B25B 9/00 29/25.35 |
| 7,246,540 | B2 * | 7/2007 | Rillera | B25B 9/00 294/100 |
| 8,863,431 | B2 | 10/2014 | Williams et al. | |
| 2004/0041423 | A1 * | 3/2004 | Cannon | B25B 9/00 294/100 |

FOREIGN PATENT DOCUMENTS

| | | |
|---|---|---|
| FR | 923289 | 2/1947 |
| WO | WO-2016107891 | 7/2016 |

* cited by examiner

MORTAR SHELL EXTRACTION SYSTEM

PRIORITY CLAIM TO RELATED APPLICATIONS

This application is a U.S. national stage application filed under 35 U.S.C. § 371 from International Application Serial No. PCT/EP2015/081385, which was filed 30 Dec. 2015, and published as WO2016/107891 on 7 Jul. 2016, and which claims priority to European Application No. 15382001.4, filed 2 Jan. 2015, which applications and publication are incorporated by reference as if reproduced herein and made a part hereof in their entirety, and the benefit of priority of each of which is claimed herein.

OBJECT OF THE INVENTION

The invention relates to a mortar shell extraction system for mortar shells of any caliber, which allows extracting from the mortar a shell that has not been cast out of the mortar and therefore remains inside it.

BACKGROUND OF THE INVENTION

A mortar shell which for any reason does not work properly inside the mortar, i.e., it has not been cast out of the mortar and remains inside it, presents a potential safety risk, given that it is a live ammunition susceptible of being able to injure people and/or damage property. Therefore, it is necessary to remove this shell from the weapon in a safe and completely reliable manner. The extraction system of the invention allows extracting the shell, complying with safety requirements necessary for such operations, in which manual intervention on a potentially dangerous material due to its internal explosive charge is required.

The usual techniques for extracting shells from a mortar are disclosed in patent documents such as EP1712872 or U.S. Pat. No. 2,770,988.

The first document discloses an extraction system that uses permanent magnets that work around a rotational shaft for extracting the shell from the mortar tube. This method is incompatible with current shells which have electronic fuses because the use of magnets could initiate the shell during extraction, therefore representing a danger for the user.

The second patent document discloses an extraction device for extracting shells from inside a mortar tube requiring a cord that can be lowered down the mortar tube together with guiding parts. The projectile is extracted by means of a pawl, using a tractive force. This device does not allow extracting shells in the event that the surface of said shells is not completely dry, in addition to requiring a process for preparing the extraction device that is complicated and not very safe due to the system of guiding parts and the cord which said device requires.

DESCRIPTION OF THE INVENTION

The present invention proposes a solution to the aforementioned problems by means of an extraction system according to claim 1. The dependent claims define preferred embodiments of the invention.

The first inventive aspect corresponds to a mortar shell extraction system comprising:

- gripping means adapted for being inserted into the mortar and holding the shell by the fuse,
- at least one connecting shaft connected to the gripping means,

- driving means connected to the at least one connecting shaft and configured for transmitting a driving force to the gripping means through the at least one connecting shaft.

The gripping means of the extraction system allow holding the shell, said gripping means comprising the components suitable for said holding depending on the type of fuse mounted in any type of mortar shell.

This advantageously allows extracting any type of shell trapped inside the mortar, such that it is not necessary to provide different extraction systems depending on the diameter of the shell or the type of fuse mounted therein.

The driving force is transmitted from the user through the components of the extraction system, particularly the driving means. Said user operates the driving means such that movement occurs, which movement, transmitted along the connecting shaft to the gripping means, is converted into a force such that the gripping means are driven so that they grip the shell, regardless of the configuration of said gripping means.

This has the additional advantage of easy use of the shell extraction system object of the invention, because the user operates said system the same way, regardless of the type of fuse of the shell to be extracted, by simply mounting suitable gripping means in the extraction system. The operating simplicity of the extraction system of the invention, as well as how quickly the shell extraction operation is carried out are highly appreciable.

In a particular embodiment, the shell extraction system further comprises holding means which make it easier for a user to hold the extraction system.

The holding means advantageously allow the user to stably retain the extraction system.

The holding means additionally comprise a length that is suitable for inserting the shell extraction system in the mortar such that the user is far enough away from the line of fire of said mortar, exposing no body part to the line of fire of the mortar when using the system to extract a shell, the system therefore being safer than those extraction systems existing in the state of the art.

In a particular embodiment, the shell extraction system further comprises actuating means configured for transmitting movement to the driving means.

These actuating means allow the user to operate the driving means in a simpler and more accessible manner.

In a particular embodiment, the shell extraction system comprises actuating means arranged such that they are capable of performing rotational movement, and the driving means are configured for being driven by the rotational movement of the actuating means and for converting said rotational movement into linear movement which is transmitted to the at least one connecting shaft.

In a particular embodiment, the actuating means comprise a lever with defined fixed positions between which the user can operate said actuating means. The different positions are achieved by rotational movement of the actuating means, particularly of the lever. This rotational movement applied for obtaining the change in position of the lever is transmitted to the driving means where it is converted into linear movement, such that said linear movement is transmitted through the at least one connecting shaft to the gripping means and is converted in said gripping means into the gripping force necessary for retaining the shell for extraction.

In a particular embodiment of the shell extraction system, the actuating means are movably arranged, and the driving means are configured for being driven by a change in position of the actuating means and for converting said movement into linear movement which is transmitted to the at least one connecting shaft.

In this embodiment, the actuating means have defined fixed positions in which the user can operate said means. The different positions are achieved by movement of these actuating means, for example, a movable rod that can move between two positions, an upper position and a lower position. This movement applied for obtaining the change in position of the actuating means is transmitted to the driving means where it is converted into linear movement, such that said linear movement is transmitted through the at least one connecting shaft to the gripping means and is converted in said gripping means into the gripping force necessary for extracting the shell.

In a particular embodiment of the shell extraction system, the linear movement transmitted to the at least one connecting shaft drives the gripping means for holding the shell.

This drive advantageously allows converting linear movement into a driving force such that it is sufficient for extracting the shell.

In a particular embodiment, the connecting shaft is adapted for converting the movement it receives from the driving means into radial clamping movement and for transmitting it to the gripping means.

This advantageously allows extracting shells based on an element that surrounds the outer surface of said shell. The change in position applied in the actuating means is transmitted to the gripping means in the form of linear movement, converted in the gripping means into radial clamping movement such that said gripping means transmit such movement through their components, causing said components to close around the outer surface of the shell.

In a particular embodiment, the shell extraction system comprises an elastic clamping element allowing perimetral deformation thereof such that it is capable of housing an outer surface of the fuse of the shell by clamping.

This advantageously allows regulating the size of the clamping element, the latter being fitted to the outer diameter of the surface of the fuse of the shell. The clamping element surrounds the fuse of the shell for extraction thereof.

In a particular embodiment, the at least one connecting shaft converts the movement it receives from the driving means into rotational movement and transmits it to the gripping means.

The connecting shaft allows converting the movement applied by the user on the actuating means and received by the driving means and transmitted to said connecting shaft. Transmitting movement from the connecting shaft allows it to reach the gripping means, wherein said transmitted movement is converted into the force of actuation necessary for the extraction of the shell.

In a particular embodiment, the gripping means comprise a clamp suitable for interlocking with a surface of the fuse of the shell by press fit. Said surface is preferably a notched surface.

Said clamp allows extracting the shell by means of it acting on a surface of the shell adapted for that purpose. The clamp is housed on said surface, preferably a notch, and the driving force on the gripping means allows said clamp to interlock inside the notch by press fit.

In a particular embodiment, the shell extraction system additionally comprises a safety element located between the holding means and the driving means which allows increasing the distance between the holding means and the path of the mortar.

The safety system advantageously allows the user to move further away from the path of the mortar, as well as providing the user with easier and faster access to the actuating means.

In a particular embodiment, the shell extraction system comprises a safety element attached to the holding means by an interface configured for allowing rapid decoupling of the holding means with respect to the safety element and to the rest of the system.

The interface is an element which allows attaching holding means to the safety element, such that in the event of accidental initiation of the mortar shell during the extraction process, the safety element is separated from the interface and is cast out together with the rest of the extraction system and with the shell, the user keeping the holding means and the interface, which remain attached to one another, held together.

In a particular embodiment, the shell extraction system comprises a centering element adapted for positioning the extraction system inside the mortar tube.

Said centering element is mounted on the at least one connecting shaft, before the gripping means.

In a particular embodiment, said centering element has the same diameter as the mortar tube, such that once it is inserted in said tube, it abuts with the walls of the mortar tube and allows the gripping means to be inserted and properly positioned on the shell in a centered manner.

All the features described in this specification (including the claims, description and drawings) can be combined in any combination, with the exception of the combinations of such mutually exclusive features.

DESCRIPTION OF THE DRAWINGS

The foregoing and other features and advantages of the invention will become clearer based on the following detailed description of a preferred embodiment, given only by way of illustrative and non-limiting example, in reference to the attached drawings.

DETAILED DESCRIPTION OF THE INVENTION

Figure 1:
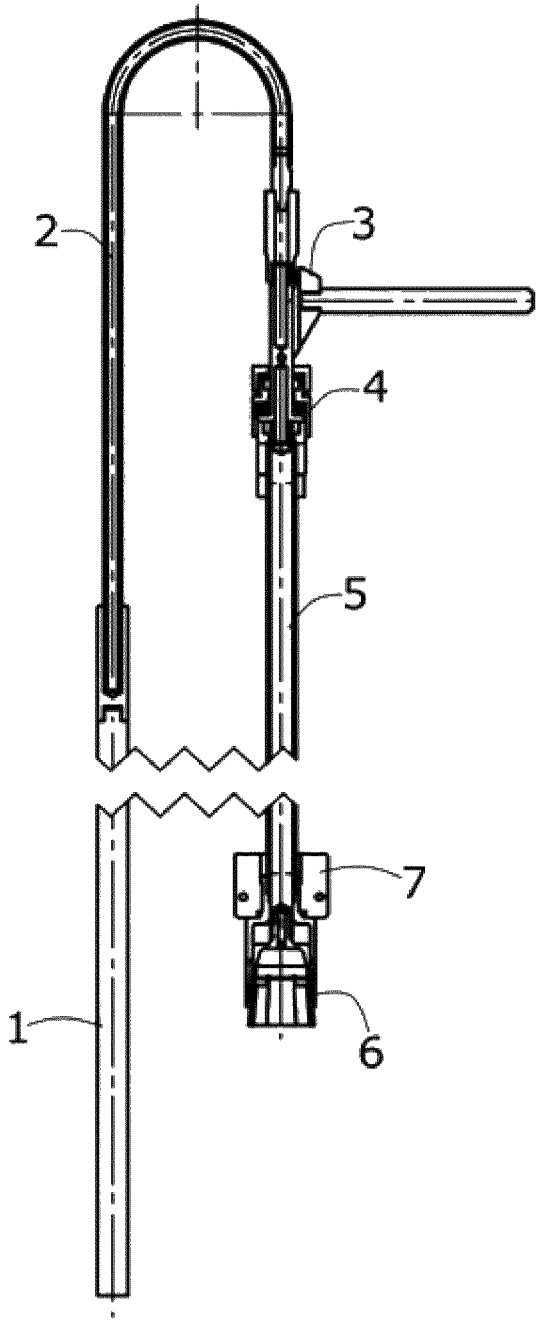
FIG. 1 shows a front view of a shell extraction system according to an embodiment of the invention.

FIG. 1 shows a first embodiment of the extraction system of the invention. The shell extraction system allows removing a shell that has not detonated after an operating failure of said shell inside the mortar. Said shell is housed in the mortar tube, from where it must be safely removed to prevent detonation therein.

The shell extraction system comprises holding means (1) which allow the user to hold the extraction system during the operation of inserting the system into the mortar and during the operation of extracting the system together with the shell once said shell is gripped by the system in the extraction system usage situation.

Said holding means (1) allow holding the extraction system such that the user can safely remove the shell. The holding means (1) preferably have a length that can be adapted to the length of the mortar tube from where the shell is to be extracted.

In this embodiment, the holding means (1) are attached to a first end of a safety element (2) through an interface. The attachment between the holding means (1) and the interface is a threaded attachment. The attachment between the interface and the safety element (2) is a diametral fit, which allows the immediate decoupling of the interface from the safety element (2) in the event of the accidental initiation of the mortar shell during the extraction process.

The safety element (2) is attached at its other end to the actuating means (3), through a connector (26).

The actuating means (3) allow the user to apply movement which is transmitted to the shell, causing the gripping of the shell to extract it from the mortar.

In this embodiment, the actuating means (3) comprise a lever (23) adapted for performing rotational movement. The rotational movement of the lever (23) is transmitted to the driving means (4) as longitudinal movement. Said driving means (4) generate the clamping force necessary for holding the shell (A) from the longitudinal movement received from the actuating means (3).

In another particular embodiment, the actuating means (3) can move between two different positions, according to which positions a movement that allows similar longitudinal movement towards the driving means (4) is generated. Said two positions are separated according to a longitudinal movement.

The driving means (4) are attached at the other end thereof to a connecting shaft (5), such that the shaft (5) receives the clamping force generated in the driving means (4) and transmits it to the shell for holding said shell.

In turn, the connecting shaft (5) is attached to the gripping means (6) which allow holding the shell to extract it from the mortar.

In this embodiment, the safety element (2) is configured as an element with a bent sector which allows the user of the extractor system to hold it by the holding elements (1) along an axis that is shifted away from the longitudinal axis of the connecting shaft, thereby assuring that no part of the user's body is exposed to the line of fire of the mortar during the shell extraction operation.

In this particular embodiment, the connecting shaft (5) transmits longitudinal movement from the driving means (4) to the gripping means (6).

The centering element (7) envisaged in this embodiment advantageously makes it easier for the gripping means (6) to be located in the suitable position inside the mortar (B).

Figure 2:
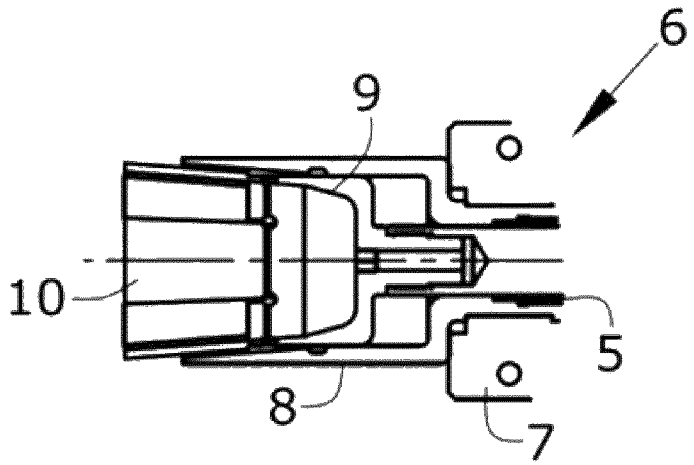
FIG. 2 shows a detail view of the gripping means of a shell extraction system according to a first embodiment.

FIG. 2 shows an embodiment of the gripping means (6), in which the shell is held by clamping, such that the outer surface of the shell, particularly the outer surface of the fuse of the shell, is held by interference through an elastic clamping element (10). This embodiment is particularly advantageous in the case of shells that do not have a holding area. In this embodiment, in addition to the elastic clamping element (10), the gripping means (6) comprise an outer body (8) and an inner body (9). The clamping element (10), which is integral with the inner body (9), performs its holding function through the longitudinal movement received from the connecting shaft (5).

Figure 3:
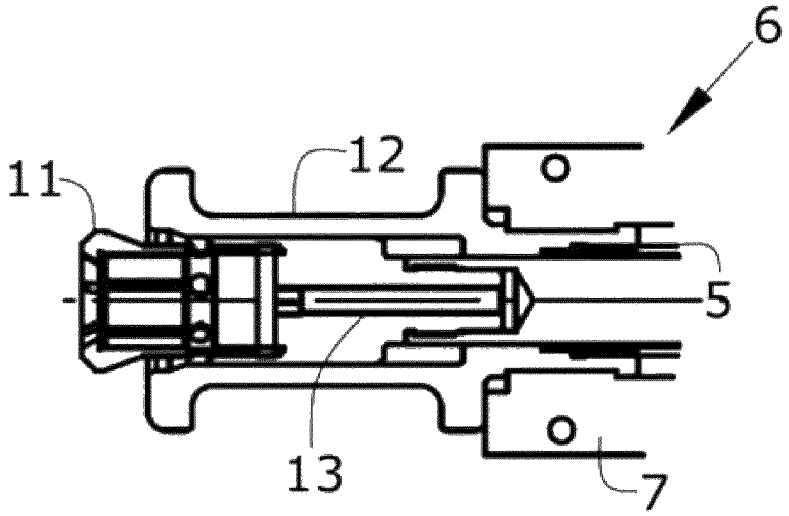
FIG. 3 shows a detailed view of the gripping means of a shell extraction system according to a second embodiment.

FIG. 3 shows a second embodiment of the gripping means (6) wherein the shell is held by press fit. In this embodiment, the gripping means (6) comprise a clamp (11) adapted for being clamped onto a holding surface of the shell, for example a notch, an actuator body (12) and a clamp holder (13). In the embodiment shown, the clamp (11) allows gripping the shell (A) by means of the housing or interlocking in a notch of the fuse of the shell (A). The gripping means (6) are activated through the longitudinal movement received from the connecting shaft (5).

Figure 4:
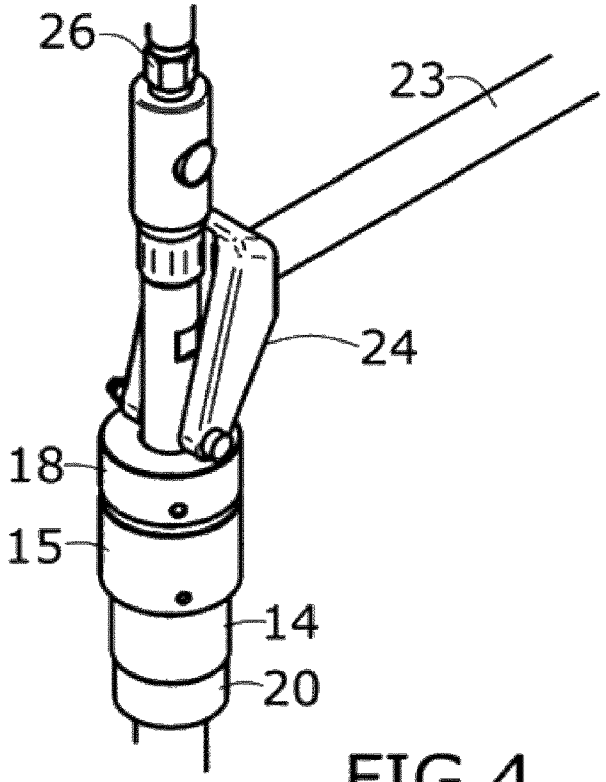
FIG. 4 shows an embodiment of the actuating means.

FIG. 4 shows an embodiment of the actuating means (3) which in this case comprise a lever (23), a clamping cam (24) and a connector (26).

Figure 5:
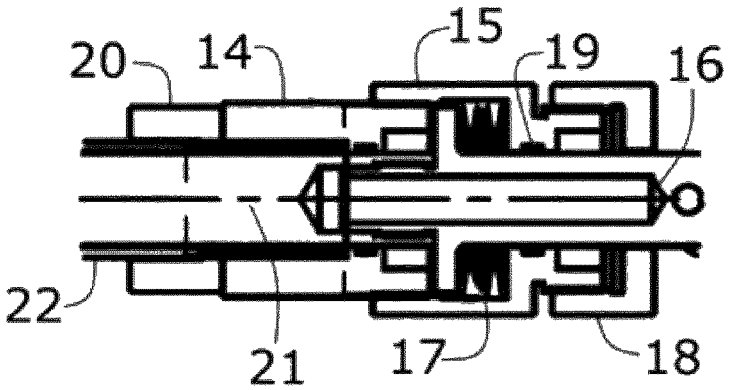
FIG. 5 shows an embodiment of the driving means.

FIG. 5 shows an embodiment of the driving means (4) comprising a body (14), a release adapter (15), a coupler (16), an elastic assembly (17), a regulator (18), a guide ring (19) and a clamping nut (20). One end of the connecting shaft (5), connected to the driving means (4), can also be seen in FIG. 5. In this embodiment, the connecting shaft (5) comprises a transmission rod (21) arranged inside a sleeve (22).

The driving means (4) are responsible for transmitting rotational movement of the lever (23) as longitudinal movement of the transmission rod (21) along the inside of the sleeve (22). The driving means (4) generate the force necessary for gripping the shell from the longitudinal movement of the transmission rod (21) of the connecting shaft (5). In turn, the transmission rod (21) allows transmitting longitudinal movement from the driving means (4) to the gripping means (6), sliding along the inside of the sleeve (22).

Figure 6:
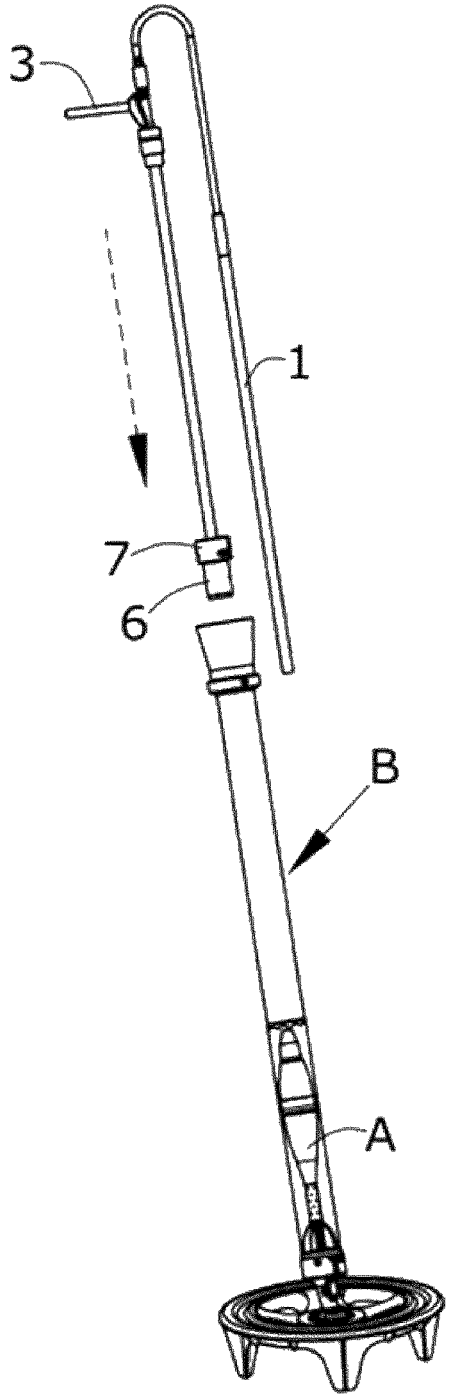
FIG. 6 shows a first step of extracting a shell with a shell extraction system according to FIG. 1.

FIG. 6 shows a first step of the extraction process for extracting a shell (A) from inside the mortar (B). The user holds the shell extraction system by the holding means (1) and inserts it, according to the longitudinal direction of the mortar (B), into the mortar (B) through the upper part thereof, i.e., through the part of the mortar (B) which has the opening where access for the shell (A) inside same is allowed.

As mentioned above, the presence of a centering element (7) makes it easier to tightly insert the gripping means (6) into the mortar (B) in a centered manner.

Figure 7:
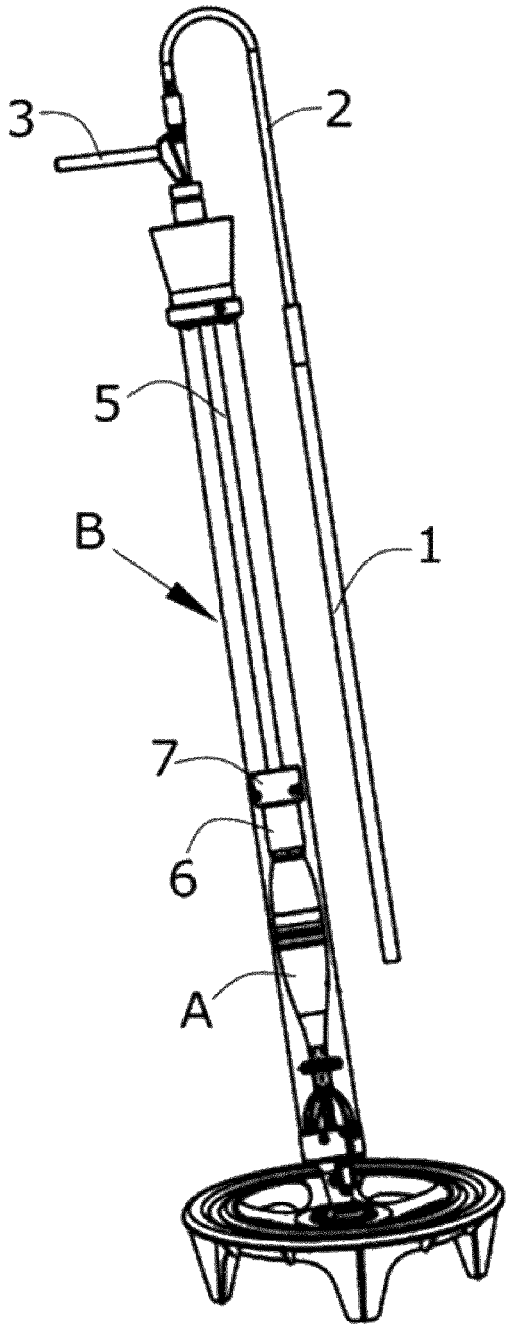
FIG. 7 shows a second step of extracting a shell with a shell extraction system according to the preceding figure.

FIG. 7 shows a second step of the extraction process for extracting a shell (A) from inside the mortar (B). Once the extraction system has been inserted into the mortar (B) tube, the gripping means (6) and connecting shaft (5) are housed therein. The actuating means (3) and driving means (4) can be accessed from the outside, such that the user can act on said actuating means (3) to generate the force needed to be transmitted, such that the gripping means (6) properly hold the shell (A). Therefore, part of the shell (A) is housed in or surrounded by the gripping means (6), such that it can be extracted.

Figure 8:
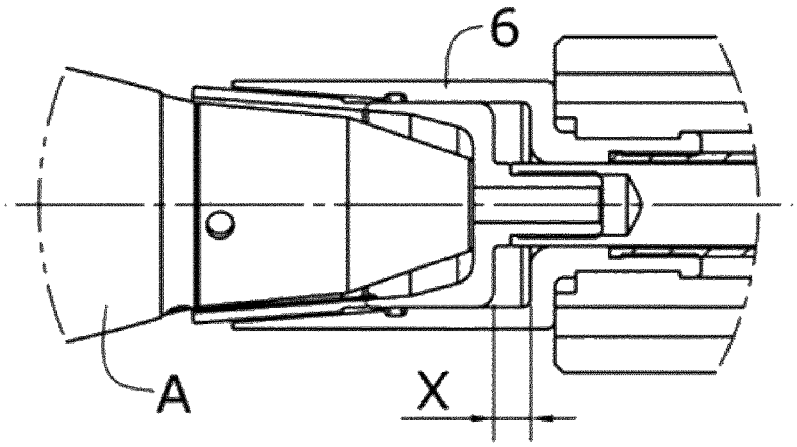
FIGS. 8 and 9 show the housing of the shell inside the gripping means shown in FIG. 2.
Figure 10:
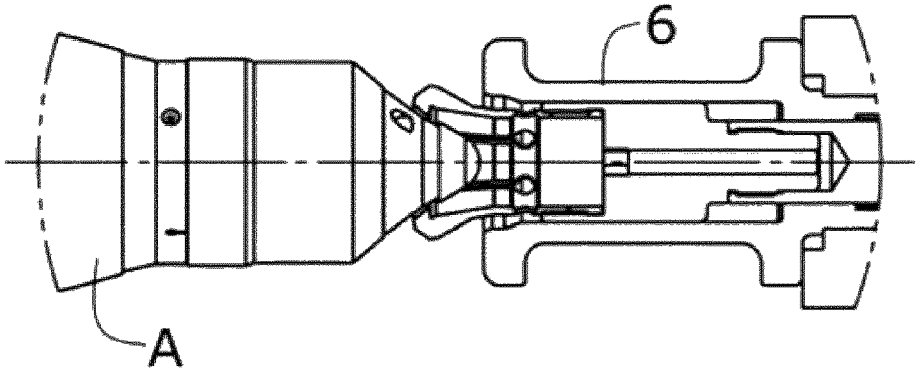
FIGS. 10 and 11 show the gripping of the shell by the gripping means shown in FIG. 3.

FIG. 8 shows the position in which the mortar shell (A) is housed inside the gripping means (6), for the case in which gripping is done by clamping. FIG. 10 shows the position in which the mortar shell (A) is positioned to be surrounded by the gripping means (6) for the case in which gripping is done by press fit. The gripping means depicted in FIGS. 8 and 10 correspond to those shown in FIGS. 2 and 3, respectively.

Figure 9:
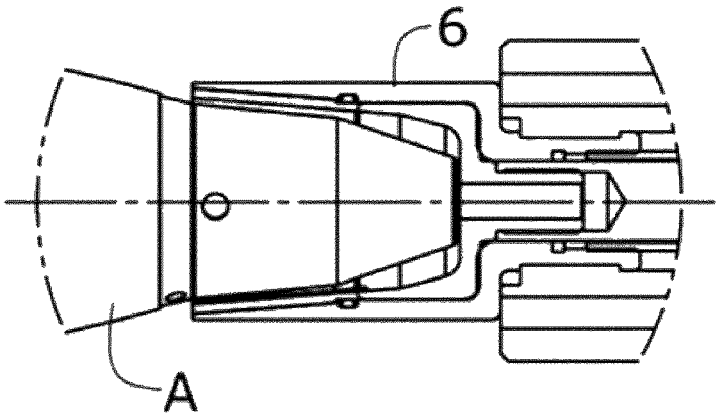

After having positioned the gripping means (6) on the shell (A), by generating a rotational movement between two specific positions in the actuating means (3), configured as a lever (23) in this case, said movement is transmitted through the driving means (4) and the connecting shaft (5) to the gripping means (6) fitted on the shell (A). In the case of gripping by clamping, this movement of the lever (23) causes longitudinal movement "x" of the transmission rod depicted in FIG. 8, which in turn causes the inner body (9) to close. Driving the lever (23) to its final position, integral with the clamping cam (24), allows the final fitting of the inner body (9) of the gripping means (6). FIG. 9 shows the final position in which the mortar shell (A) is fixed to the gripping means (6) in the case of gripping by clamping.

Figure 11:
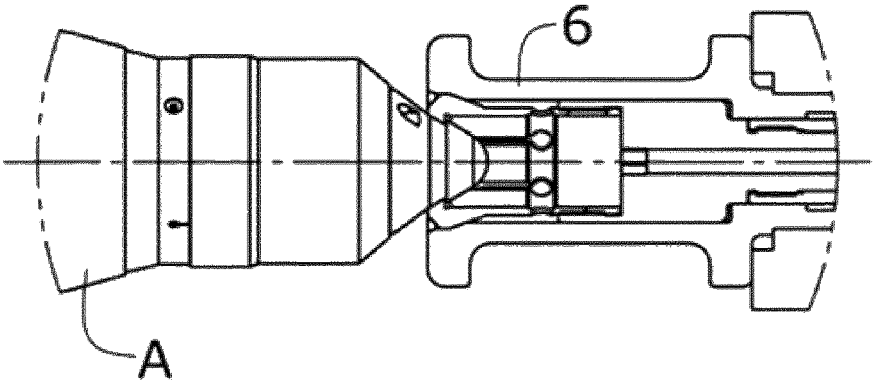

FIGS. 10 and 11 show the case of gripping by press fit. Movement of the lever (23) causes the transmission rod (21) to move, causing the clamp (11) to close. Driving the lever (23) to its final position, integral with the clamping cam (24), allows final fixing of the clamp (11). FIG. 11 shows the final position in which the mortar shell (A) is fixed to the gripping means (6) in the case of gripping by press fit.

Figure 12:
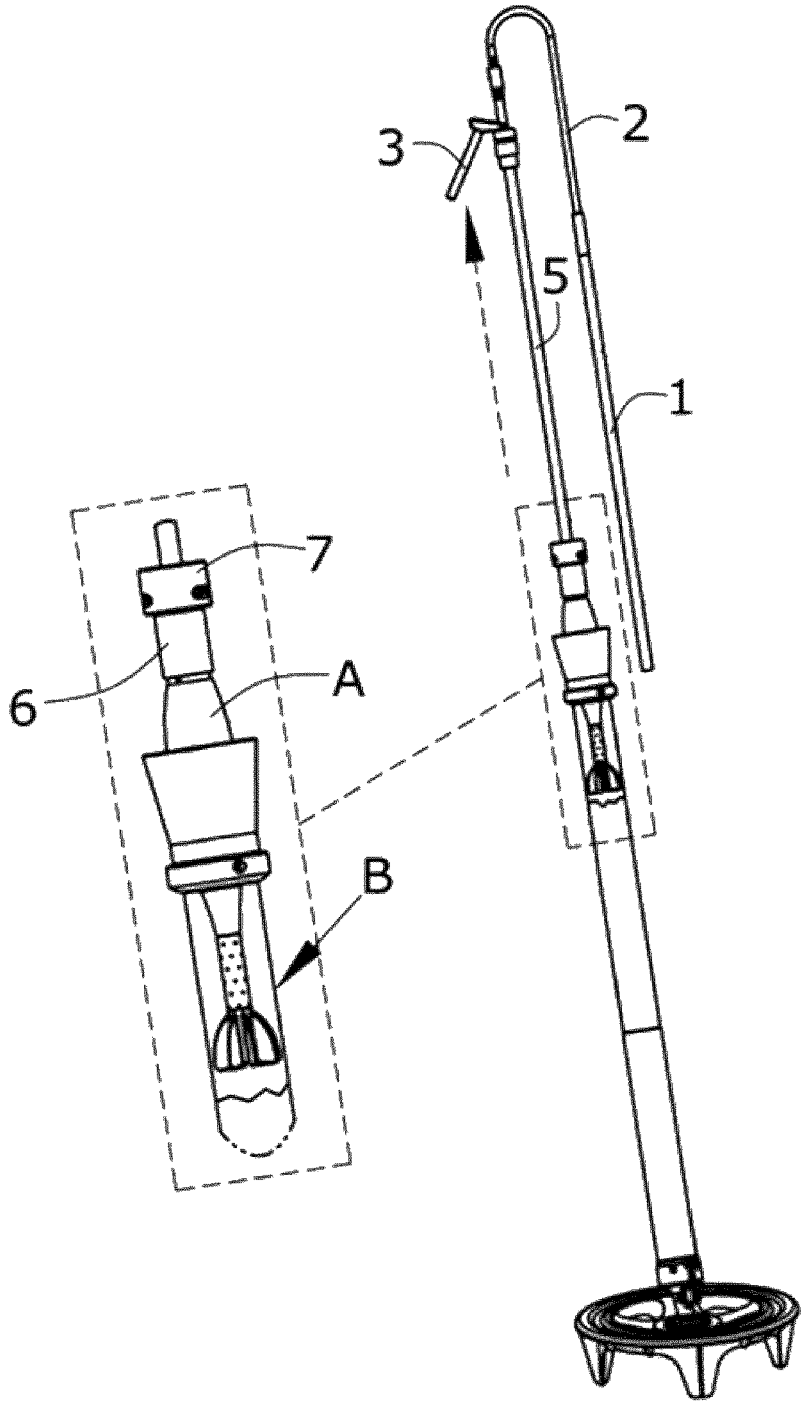
FIG. 12 shows a third step of extracting a shell with a shell extraction system according to FIG. 1.

Once the shell (A) is fixed by means of the gripping means (6), the extraction system is removed from inside the mortar (B) by means of a movement in the longitudinal direction of the mortar (B), thereby removing both the shell (A) and the extraction system. This last step is depicted in FIG. 12.

The invention claimed is:

1. A mortar shell extraction system, the extraction system comprising:

gripping means adapted for being inserted into a mortar and holding the shell by a fuse, at least one connecting shaft comprising a transmission rod arranged inside a sleeve, the transmission rod being movable inside the sleeve in the longitudinal direction of the transmission rod, wherein the at least one connecting shaft is connected to the gripping means, and driving means connected to the at least one connecting shaft, wherein the driving means is configured to transmit a driving force to the gripping means through the at least one connecting shaft, and actuating means configured to transmit movement to the driving means, wherein:

the actuating means is configured to transmit rotational movement, the driving means is configured to receive the rotational movement from the actuating means and to convert the rotational movement into linear movement that is transmitted to the at least one connecting shaft, and the at least one connecting shaft is adapted to convert the movement it receives from the driving means into a radial clamping movement and for transmitting it to the gripping means.

2. The extraction system according to claim 1, further comprising holding means which allow a user to hold the extraction system.

3. The extraction system according to claim 1, wherein the linear movement transmitted to the at least one connecting shaft drives the gripping means for holding the shell.

4. The extraction system according to claim 1, wherein the gripping means comprise an elastic clamping element allowing perimetral deformation thereof such that it is capable of housing the outer surface of the fuse of the shell by clamping.

5. The extraction system according to claim 1, wherein the gripping means comprise a clamp suitable for interlocking with a surface of the fuse of the shell by press fit.

6. The extraction system according to claim 1 further comprising a safety element located between the holding means and the actuating means, and comprising a bent sector which allows increasing the distance between the holding means and the longitudinal direction of the connecting shaft.

7. The extraction system according to claim 6, wherein the safety element is attached to the holding means by means of an interface configured for allowing rapid decoupling of the holding means and the safety element.

8. The extraction system according to claim 7, wherein the safety element and the interface are attached by means of a diametral fit.

9. The extraction system according to claim 1, further comprising a centering element adapted for positioning the extraction system inside the mortar tube.

* * * * *